US006455828B1

(12) United States Patent
Gauggel et al.

(10) Patent No.: US 6,455,828 B1
(45) Date of Patent: Sep. 24, 2002

(54) METHOD FOR REMOTE CONTROLLED COMBAT OF NEAR-SURFACE AND/OR SURFACE TARGETS

(75) Inventors: Roland Gauggel, Salem; Michael Arnold, Bad Reichenhall; Reinhard Krüger, Rückstetten bei Teisendorg; Norbert Tränapp, Bad Tölz, all of (DE)

(73) Assignee: LFK-Lenkflugkorpersysteme GmbH, Unterschleissheim (DE)

( * ) Notice: Subject to any disclaimer, the term of this patent is extended or adjusted under 35 U.S.C. 154(b) by 0 days.

(21) Appl. No.: 09/720,426

(22) PCT Filed: Jun. 25, 1999

(86) PCT No.: PCT/DE99/01862

§ 371 (c)(1),
(2), (4) Date: Jun. 12, 2001

(87) PCT Pub. No.: WO00/00779

PCT Pub. Date: Jan. 6, 2000

(30) Foreign Application Priority Data

Jun. 25, 1998 (DE) ..... 198 28 644

(51) Int. Cl.[7] ..... F41G 7/00

(52) U.S. Cl. ..... 244/3.1; 244/3.15; 244/3.17; 244/3.19; 244/3.11; 244/3.14

(58) Field of Search ..... 244/3.1, 3.11, 244/3.13, 3.14, 3.15, 3.19, 3.2, 3.16, 3.17

(56) References Cited

U.S. PATENT DOCUMENTS 5,186,414 A * 2/1993 Holzschuh et al. ..... 244/3.14
5,260,709 A * 11/1993 Nowakowski ..... 244/3.2
5,379,966 A * 1/1995 Simeone et al. ..... 244/3.13
5,458,041 A 10/1995 Sun et al. ..... 89/1.11
5,785,275 A * 7/1998 Hiebl ..... 244/3.17
5,857,644 A 1/1999 Kusters ..... 244/3.15
5,917,442 A * 6/1999 Manoogian ..... 244/3.14
5,938,148 A 8/1999 Orenstein ..... 244/3.15
6,318,667 B1 * 11/2001 Morton ..... 244/3.14

FOREIGN PATENT DOCUMENTS

| | | |
|---|---|---|
| DE | 31 45 374 | 6/1983 |
| DE | 33 03 763 | 8/1984 |
| GB | 2 148 465 | 5/1985 |

* cited by examiner

*Primary Examiner*—J. Woodrow Eldred
(74) *Attorney, Agent, or Firm*—Burns, Doane, Swecker & Mathis, LLP

(57) ABSTRACT

The invention relates to a method for combating near-surface and/or surface targets such as tanks or the like by using a missile comprising a seeker head, an effective charge and at least one thruster. According to the invention, the missile is redirected into an essentially horizontal cruising and seeking phase after completing an essentially vertical start phase. During said cruising and seeking phase, the missile scans the terrain ahead of it using the seeking head, whereupon an approaching phase which is directed in an essentially downward direction follows after the finally ensues head locks onto an identified target. An external reconnaissance system in an appropriate aircraft and/or spacecraft such as in a helicopter, a drone or in a satellite receives information for guiding the missile which is transmitted to the same.

7 Claims, 1 Drawing Sheet

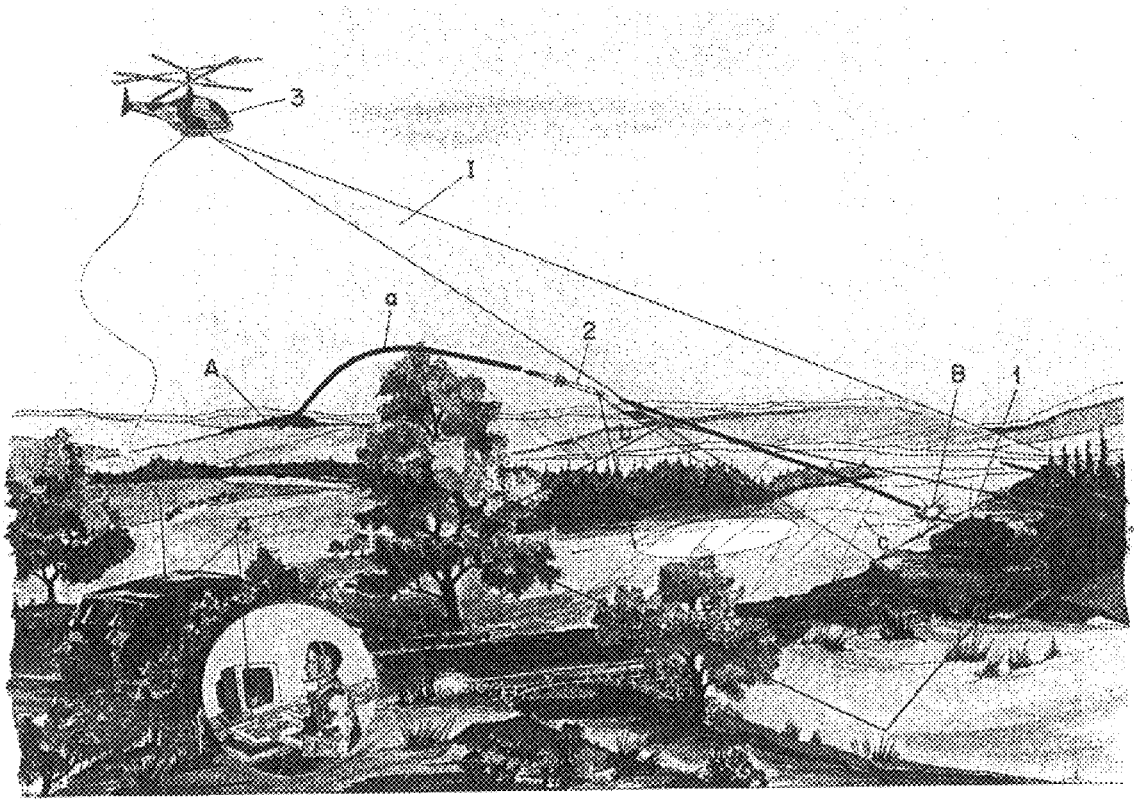
3
1
a
2
A
B
1

METHOD FOR REMOTE CONTROLLED COMBAT OF NEAR-SURFACE AND/OR SURFACE TARGETS

SPECIFICATION

The invention relates to a method of combating near-surface and/or surface-bound targets, such as tanks and the like by means of a missile comprising a homing head, an effective charge, and at least one propulsive unit, the missile, after having passed an essentially vertical launching phase, being deflected into an essentially horizontal cruising and homing phase during which the missile scans the terrain ahead by means of the homing head, whereupon finally an essentially vertically downwardly directed approaching phase follows, once the homing head has locked on to a recognized target, an external reconnaissance system in an appropriate aircraft and/or space vehicle, such as a helicopter, a drone, or a satellite picking up information for guidance of the missile.

DE 196 26 975 C1 describes a missile which hardly can be improved further, at reasonable expenditure, as regards its structure to increase the probability of hitting. However, new tank protection systems in particular, such as so-called active protection systems require further improvement.

It was suggested in DE 42 17 185 C1, for example, that a missile be divisible so that, instead of a body member containing the warhead, sensors of a tank will detect and combat a decoy body which is detachable from the body member that includes the warhead.

Furthermore, an autonomous missile is disclosed in DE 42 23 531 C2, namely a missile comprising an inertia reference system to reduce initializing errors.

Likewise known are missiles which are guided towards a target entirely by an external means, instead of autonomous missiles, especially with homing heads and/or inertia reference systems. DE 44 16 885 A1, for instance, discloses a method of guiding a missile by at least one radiation source which can be located by two sensors disposed offset from each other in a launch pad. Guide commands are derived from the locating signals and transmitted to a guide means of the missile so as to keep the missile in the line of sight of at least one sensor detecting a target. This kind of missile control is complicated with LOS operations, i.e. in case of a direct shot method, if a disturbance occurs between the launch pad and the target. The Known method, however, fails completely if the target is not in any line of sight connection with the launch pad, such as is the case with NLOS operations.

A method of the generic kind defined is known from GB-A-2 148 465 according to which the missile trajectory is adjustable by adjustment of a launch means in response to target information received from the reconnaissance system, and photographs taken by the reconnaissance system are input into the missile memory before the missile is launched.

Methods of guiding missiles which are started from airplanes are known from EP 0 797 068 A2, U.S. Pat. No. 5,458,041, and DE 37 15 909 C1.

DE 31 45 374 A1 and DE 33 03 763 A1 describe methods of combating surface targets by means of missiles. These missiles, however, cannot be guided on the basis of information which may be obtained through an external reconnaissance system.

It is, therefore, the object of the invention to improve the method of the generic kind in question such that the shortcomings of the prior art are overcome., i.e. in particular that more accurate target lock-on and a higher hit rate are achieved.

That object is met, in accordance with the invention, in that the missile guidance information picked up by the reconnaissance system are transmitted to the missile and, during the homing phase, the homing angle of the missile homing head is optimized continuously in response to target data transmitted to the missile by the reconnaissance system with a view to recognizing the target.

It may be provided, according to the invention, that the reconnaissance system scans the possible target area either statically or in flight during a mission an external reconnaissance system picking up and transmitting information for guidance of the missile.

It is likewise proposed, according to the invention, that, once a combat target has been recognized by the reconnaissance system, in particular as regards the type of target, location of target, and/or target movement, the missile is launched, under control of signals transmitted by the reconnaissance system to a missile launcher, such that the quasi-ballistic course of the missile will lead essentially to the target caught by the reconnaissance system.

According to the invention it is further preferred that, during the target approaching phase, once the target has been recognized and the missile homing head has locked on to it, the homing angle of the missile homing head is reduced and minimized largely together with a corresponding increase in resolution to recognize details of the combat target transmitted to the missile by the reconnaissance system, such as the engine area of a tank and the like.

Moreover, it may be provided according to the invention that the reconnaissance system passes on information picked up to a transmitter station and that the missile is guided to the target via the transmitter station.

Finally, it is also proposed, according to the invention that the missile supplies information to the transmitter station and this information is processed in the transmitter station, together with the data transmitted by the reconnaissance system for guidance of the missile.

The invention thus is based on the surprising finding that missiles conventionally operating autonomously by means of a homing head can be remote controlled, in addition, by a reconnaissance system and data can be transmitted permanently to the missile by the external reconnaissance system in order to continuously optimize the aiming direction of the missile during the homing phase so that, in principle, the result is a combination of two conventional homing methods, whereby the elimination of errors is greatly enhanced and the resulting hit rate far superior over the state of the art. The data link according to the invention between the missile and the reconnaissance system thus makes it possible to transmit timely target data to the missile, while in flight already, either directly or indirectly through a transmitter station, so as to increase the combat effectiveness.

Further features and advantages of the invention may be gathered from the following description which specifies an embodiment of the invention in greater detail, with reference to a diagrammatic drawing. The drawing which consists of a single FIGURE is a perspective view of a combat scenario.

The FIGURE illustrates a combat scenario where a tank 1 is to be attacked by a missile 2. To this end, a helicopter 3 flies over the possible target area, scanning the same within a cone of sight I. As soon as the helicopter 3 has recognized the tank 1 as the target, in respect of the type of target, location of target, and target movement, the helicopter 3 transmits signals to a launch means (not shown) of the missile 2 at starting point A. These signals may be transmitted by the helicopter 3 to a transmitter station 4 and then to the launch means and they contain information which permits the missile 2 to be brought from the starting point A into a quasi-ballistic course a which leads essentially to the tank 1 detected by the helicopter 3.

During the homing phase the missile 2 flies essentially horizontally and at supersonic speed. At this time, during the homing phase, the homing angle of the homing head, i.e. the cone of sight b of the guided missile 2 is optimized continuously in response to the target data transmitted by the helicopter 3 to the missile 2 with a view to recognizing the tank 1. The course c of the center of the light cone b of the missile 2 is shown in exemplary fashion in the FIG., such as it results from the remote guidance by means of the data sensed, processed and transmitted by the helicopter 3.

After the homing head of the missile 2 has recognized the tank 1 and the missile 2 has locked on to the tank 1, i.e. during the target approach phase, the angle of the light cone b of the guided missile 2 is reduced continuously in response to details of the tank 1 to be attacked which were sensed by the helicopter 3. This serves to increase the resolution within the cone of sight b of the missile 2 whereby the aiming accuracy is increased as well. In this manner it is possible, for instance, to aim directly at the engine area of the tank 1 so that the effective charge of the missile 1 will have its effect in the engine range, as symbolized in the FIG..

The features of the invention disclosed in the above specification, in the drawing, as well as in the claims may be essential to the implementation of the invention in its various embodiments, both individually and in any desired combination.

What is claimed is:

1. A method of combating a target located at least near a surface, by means of a missile comprising a homing head, an effective charge, and at least one propulsive unit, wherein the missile, after having passed an essentially vertical launching phase, being deflected into an essentially horizontal cruising and homing phase during which the missile scans the terrain ahead by means of its homing head, whereupon an essentially vertically downwardly directed approaching phase follows once the target has been selected and the homing head has locked on to a recognized target, wherein an external reconnaissance system traveling above the target area scans the target area and communicates with the missile, wherein during the homing phase following the target selection, target data pertaining to the selected target is transmitted from the reconnaissance system to the missile so that the homing angle of the missile homing head is optimized continuously in response to such target data with a view to recognizing the target.

2. The method according to claim 1, wherein the reconnaissance system is in flight while scanning the target area.

3. The method claimed in claim 2, wherein the reconnaissance system is static while scanning the target area.

4. The method according to claim 1 wherein the launching phase is performed after the target has been selected.

5. The method according to claim 1, wherein during the approaching phase the homing angle of the missile homing head is reduced and minimized largely together with a corresponding increase in resolution, to recognize details of the target transmitted to the missile by the reconnaissance system.

6. The method according to claim 1 wherein the target data transmitted from the reconnaissance system to the missile travels through a transmitter station.

7. The method according to claim 6 wherein the transmitter station receives information from the missile and processes such received information, together with target data received from the reconnaissance system and produces therefrom a guidance signal that is transmitted to the missile.

* * * * *